United States Patent [19]

Caughran

[11] Patent Number: 4,712,526

[45] Date of Patent: Dec. 15, 1987

[54] PISTON WITH TURBINE FAN FOR USE IN INTERNAL COMBUSTION ENGINES

[76] Inventor: David Caughran, 3743 Mt. Blance Cir., Anchorage, Ak. 99508

[21] Appl. No.: 821,893

[22] Filed: Jan. 23, 1986

[51] Int. Cl.[4] ..... F02F 3/24; F02M 29/00

[52] U.S. Cl. ..... 123/307; 123/590; 123/279

[58] Field of Search ..... 123/590, 592, 193 P, 123/307; 92/31, 173, 187

[56] References Cited

U.S. PATENT DOCUMENTS

| | | | |
|---|---|---|---|
| 1,590,204 | 6/1926 | Powell | 123/590 |
| 1,818,339 | 8/1931 | Lang | 123/279 |
| 2,762,348 | 9/1956 | Meurer | 123/279 |
| 4,357,915 | 11/1982 | Monsour | 123/307 |
| 4,455,974 | 6/1984 | Shapiro et al. | 123/193 P |
| 4,487,179 | 12/1984 | Hercher | 123/193 P |

*Primary Examiner*—Craig R. Feinberg

*Attorney, Agent, or Firm*—Michael Tavella

[57] ABSTRACT

A new piston design is disclosed for use in internal combustion engines. The invention consists of a piston that has a turbine insert installed inside an internal cavity. The turbine insert has a set of turbine blades mounted under the piston head. The piston head has an inlet port, located in the center of the piston head, and a series of outlet ports concentrically placed around the perimeter of the piston head. In practice, the air fuel mixture in the cylinder is forced into the piston through the piston inlet port as the piston is moved towards the cylinder head during the compression stroke. The air fuel mixture is then swirled by the turbine blades within the piston and then forced out of the piston through the outlet ports. One embodiment of the invention uses angled outlet ports that help direct the air/fuel mixture to the center of the cylinder. A second embodiment of the invention disloses a threaded turbine assembly instead of the pin-held insert of the first embodiment.

13 Claims, 6 Drawing Figures

PISTON WITH TURBINE FAN FOR USE IN INTERNAL COMBUSTION ENGINES

TECHNICAL FIELD

This invention relates to pistons for internal combustion engines, and more particularly to pistons having integral turbine fan blades.

BACKGROUND OF THE INVENTION

Since the invention of the reciprocating piston engine, attempts have been made to improve the engine's performance. Recently, with the escalating fuel prices of the past years, even greater attempts have been made to improve the efficiency of these engines. Also, the problems of air pollution have become serious to the extent that new methods of burning fuels in engines are being utilized with an emphasis for more complete combustion of the fuel. Currently, this is being attempted by improving the air-fuel ratio by leaning the mixture. In order to achieve complete combustion, however, and still retain performance, several devices have been developed to swirl the air-fuel mixture either during the compression stage or during the power stroke. Examples of such devices can be found in U.S. Pat. Nos. 4,467,752, 4,357,915, and 4,162,661.

BRIEF DESCRIPTION OF THE INVENTION

The present invention comprises a piston, mounted on a crank by means of a wrist pin, that has a hollowed out inner cavity. A turbine fan blade system is fixedly mounted inside of the hollowed out inner cavity, such that as the piston moves upwards on the compression stroke, air is forced into the cavity, through the blades, from the center of the piston to the outer walls of the piston, where it is ejected back into the cylinder. The piston has a solid top (head) that has an inlet port, located in the center of the piston, and a plurality of outlet ports spaced at given intervals around the perimitter of the piston head. The inlet port acts to direct the air from the cylinder into the piston cavity and through the turbine blades. The outlet ports are located to direct the swirled air back out of the cavity and into the cylinder. The outlet ports are directed to force the air-fuel mixture in the direction of the spark plug to ensure as complete combustion as possible.

It is an object of this invention to make an improved piston design that will increase the efficiency of the internal combustion engine.

Another object of the invention is to provide a simple, but effective swirling means to improve engine performance.

DETAILED DESCRIPTION OF THE INVENTION

Figure 1:
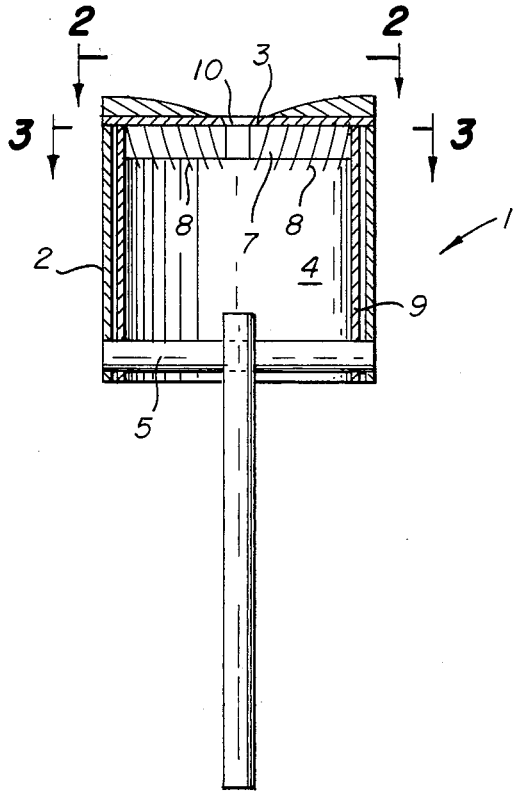
FIG. 1 is a side view of the invention.

Referring now to the drawings, and more particularly to FIG. 1, the present invention is a combination using a piston found in an internal combustion engine with an insert having turbine blades to swirl the air. Another feature of the present invention is an air inlet placed in the center of the piston top, to allow air to enter the turbine cavity, and a series of outlet ports concentrically placed around the perimiter of the piston. The device is designed to be installed a part of a new piston, or can be installed on an existing piston in retrofit.

In detail, a piston 1, having a cylindrical outer wall 2, and a top 3 is provided with an insert portion 4. The insert portion 4 is designed to fit inside the piston 1. A retaining pin 5 is provided to retain the insert in place within the piston, but enable it to be easily removed for maintenance. This pin is similar to the pin that is used to secure a regular piston to the connecting rod. The pin 5 is designed to pass through the piston wall 2, the wall of the insert 4, the connecting rod, and then again through the insert wall 4 and finally back through the piston wall 2. The pin 5 must be recessed in the piston wall 2 to prevent contact with the cylinder wall.

Figure 3:
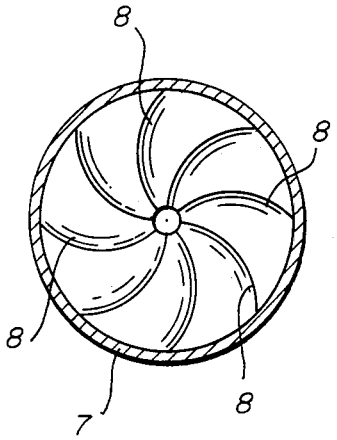
FIG. 3 is a plan view of the invention taken along the line 3—3.

Referring now to FIG. 3, the insert is provided with a turbine frame 7, which has a number of concentrically placed blades 8. The blades are spaced about the frame 7 in such a manner as to swirl the air fuel mixture and to direct it towards the air outlet means on the perimeter of the piston head 3. The turbine frame 7 is fixedly attached to the wall 9 of the insert portion 4. When installed within the piston 1, the turbine frame 7 is not designed to move or rotate in any way.

Figure 2:
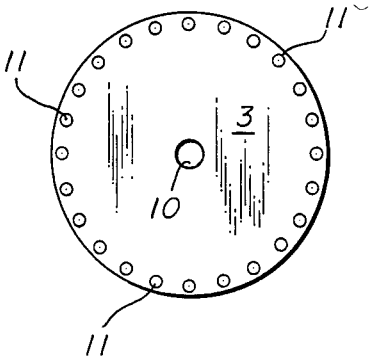
FIG. 2 is a plan view of the invention taken along the line 2—2.

Referring now to FIG. 2, the top (or head) of the piston 3 is provided with an air inlet means 10 which is designed to permit the forced flow of air through the piston head and the turbine frame 7. In the preferred embodiment, the air intake means 10 is funneled in shape (see FIG. 4). This funneling is designed to accelerate the inlet air through the turbine frame 7 to allow for a more efficient swirling.

Figure 4:
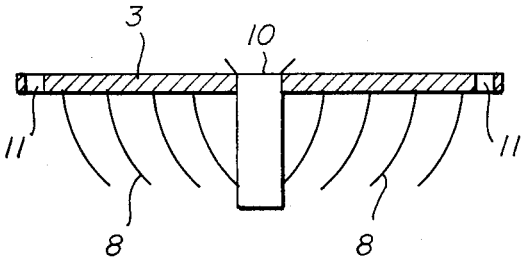
FIG. 4 is a detail view of one embodiment of the air intake and outlet means.
Figure 5:
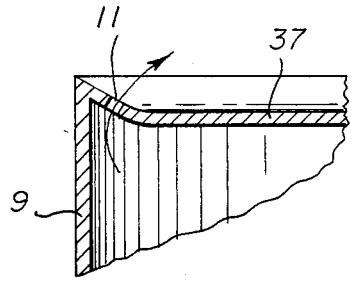
FIG. 5 is a detail view of a second air outlet arrangement.

As the air passes through the turbine frame 7 on the compression stroke, it is swirled by the blades 8 to the perimeter of the piston top 3. A series of air outlets 11 are concentrically placed around the permeter of the piston head 3 at such locations as to allow the free flow of air from the turbine frame 7 back through the piston head 3 and into the cylinder for combustion. These air outlets 11 can be either placed flat in the head (as shown in FIG. 4), or angled (as shown in FIG. 5). The angled design is preferred as it forces the air into a more focused stream toward the spark plug.

Figure 6:
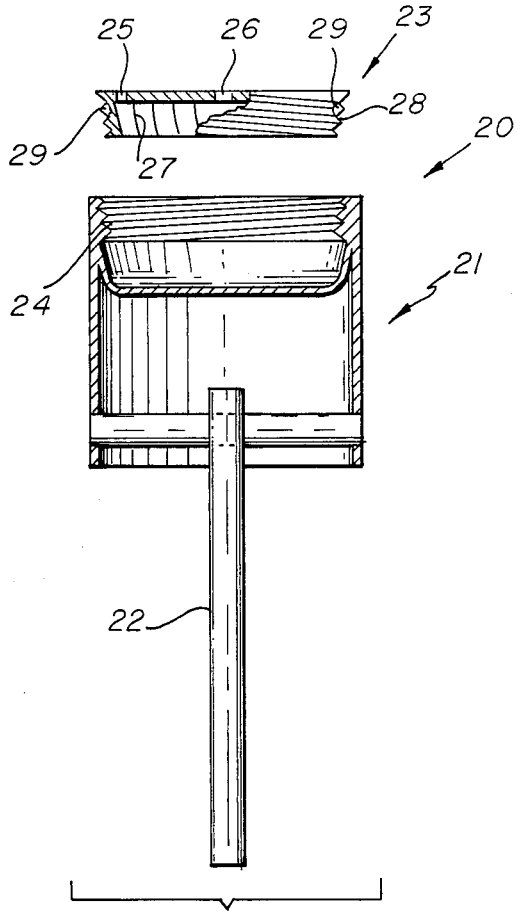
FIG. 6 is a detail view of a second embodiment of the invention.

Referring now to FIG. 6, a second embodiment of the invention is shown. This embodiment consists of a removable piston head-turbine assembly. The piston 20 has two components: the lower body 21, which is connected to the connecting rod 22 in the usual manner, and the turbine assembly 23. The lower body 21 has a dished portion formed inside of it to provide room for the turbine assembly 23. The turbine assembly must not contact the bottom of the dished portion. There must be a space to allow for proper air flow.

The lower unit 22 also has a female threaded portion 24 around the perimeter or the top edge of the lower unit 21. The turbine assembly 23 is a single unit piston head that has all of the components relating to the turbine action installed. The unit 23 has the main intake port 26, the exhaust ports 25 and the fixed turbine blade 27 integrally installed as one unit. The turbine assembly also has a male threaded portion 28 around its perimeter, which is designed to mate with the threaded portion 24 of the lower unit. The threads must be designed to provide a tight seal between the piston head unit and the lower unit. The turbine assembly 23 can also have a series of notches 29 cut into the outer portion of the assembly to provide a gripping means for a torquing tool. Although notches are preferred, any other method for providing adequate grip for the tool can be used, provided that it does not interfere with the operation of the piston in the cylinder.

It is intended that the present disclosure should not be construed in any limited sense other than that limited by the scope of the following claims having regard to the teachings herein and the prior art being apparent with the preferred form of the invention disclosed herein and which reveals detail of structure of a preferred form necessary for a better understanding of the invention and may be subject to modification by skilled persons within the scope of the invention without departing from the concept thereof.

What I claim is:

1. A piston, mounted in a cylinder having spark means, for use in an internal combustion engine comprising:

A. a cylindrical casing, having a hollow cavity therein with closed side and bottom walls;

B. a top portion, having a perimeter fixedly attached to said hollow cavity of said cylindrical casing, thereby forming an integral unit;

C. turbine blade means fixedly mounted so as to be positioned inside the hollow cavity of said cylindrical casing;

D. air inlet means, installed in said top portion to allow entry of air and fuel, in a mixture, into said hollow cavity of said cylindrical casing;

E. air outlet means also installed in said top portion to allow exit of the air fuel mixture out of said hollow cavity after said air fuel mixture has been swirled by said turbine blade means.

2. The piston of claim 1 wherein said air inlet means comprise the top portion having a hole centrally located therein.

3. The piston of claim 1 wherein said air inlet means comprise a venuri pipe, fixedly attached to said top portion such that said venturi pipe passes air through the top portion into the hollow cavity.

4. The piston of claim 1 wherein said air outlet means comprise the top portion having a plurality of holes concentrically spaced about the perimeter of the top portion.

5. The piston of claim 4 wherein said top portion is provided with an angled perimiter in which said plurality of air outlet holes are located; the angle being used to direct the air fuel mixture from the top portion directly toward the spark plug means located inside of said cylinder.

6. A piston, having a body, having an underside, and a head having a perimeter, installed in a cylinder having spark means to ignite an air fuel mixture, which is injected into said cylinder, said combination commonly found in an internal conbustion engine wherein the improvement comprises:

A. an insert having closed side and bottom walls which is fixedly installed into the body and in contact with the head of said piston, having therein a turbine being spaced at a fixed distance from the underside of the piston head;

B. pin means to fixedly secure said insert in place within said piston body;

C. the piston head also having air inlet means such that the air-fuel mixture present inside said cylinder can be drawn into the piston body by said turbine within the insert;

D. the piston head also having outlet air means such that the air fuel mixture present inside said piston body can be forced back into said cylinder by the turbine within the insert.

7. The piston of claim 6 wherein said air inlet means comprise the head having a hole centrally located therein.

8. The piston of claim 6 wherein said air inlet means comprise a venuri pipe, fixedly attached to said head such that said venturi pipe passes air through the head into the insert.

9. The piston having a head of claim 6 wherein said air outlet means comprise the head having a plurality of holes concentrically spaced about the perimiter of the head.

10. The piston of claim 9 wherein said head is provided with an angled perimiter in which said plurality of air outlet holes are located; the angle being used to direct the air fuel mixture from the head directly toward the spark plug means located inside of said cylinder.

11. A piston, mounted in a cylinder having spark means to ignite an air fuel mixture, for use in an internal combustion engine comprising:

(A) a lower body having connecting means to a connecting rod, said lower body being generally cylindrical in shape, said lower body also having an internal cavity having closed side and bottom walls;

(B) a turbine assembly portion having a top and a bottom, said turbine assembly portion having fixed turbine blades mounted on the bottom of said turbine assembly portion such that said blades will fit within the cavity of said lower body, integral inlet air means being fixedly installed into a head of said piston such that the air fuel mixture present inside said cylinder can be drawn into the lower body by said turbine blades, and outlet air means being fixedly installed into said head of said piston such that the air fuel mixture present inside said lower body can be forced back into said cylinder by the turbine blades;

(C) attachment means, fixedly attached to said lower body, to removably fasten said lower body to said turbine assembly portion;

(D) attachment means, fixedly attached to said turbine assembly portion to removably fasten said lower body to the top of said turbine assembly portion via said attachment means on said lower body.

12. The piston of claim 11 wherein said attachment means on said lower body comprise female threads and the attachment means on said turbine assembly portion comprise a male threaded portion that will engage the female threads.

13. The piston of claim 12 further comprising notch means installed on an outer perimeter of said turbine assembly portion to provide gripping points for torquing tools.

* * * * *